United States Patent [19]

Rudick et al.

[11] Patent Number: 4,822,531

[45] Date of Patent: Apr. 18, 1989

[54] NON-VENTING MICROGRAVITY CARBONATOR AND METHOD

[75] Inventors: Arthur G. Rudick, Marietta; Hugh Y. Torrance, Roswell, both of Ga.

[73] Assignee: The Coca-Cola Company, Atlanta, Ga.

[21] Appl. No.: 210,501

[22] Filed: Jun. 23, 1988

[51] Int. Cl.[4] ..... B01F 3/04

[52] U.S. Cl. ..... 261/25; 261/35; 261/82; 261/DIG. 7

[58] Field of Search ..... 261/82, 35, 25, DIG. 7

[56] References Cited

U.S. PATENT DOCUMENTS

| | | | |
|---|---|---|---|
| 883,257 | 10/1906 | Southey et al. | 261/82 |
| 2,604,310 | 7/1952 | Brown | 261/82 |
| 3,226,099 | 12/1965 | Black et al. | 261/82 |
| 3,323,783 | 6/1967 | Schwertfeger et al. | 261/35 |
| 3,527,213 | 8/1970 | Schreiber | 261/35 |
| 3,756,576 | 9/1973 | Tremolada | 261/82 |
| 4,096,059 | 6/1978 | Pinkerton | 137/99 |
| 4,304,736 | 8/1981 | McMillin et al. | 261/35 |
| 4,515,516 | 7/1985 | Perrine et al. | 417/38 |
| 4,629,589 | 12/1986 | Gupta et al. | 261/34.1 |

*Primary Examiner*—Tim Miles

*Attorney, Agent, or Firm*—Birch, Stewart, Kolasch, & Birch

[57] ABSTRACT

A method for carbonating water and a carbonator which can be used on earth or in the microgravity conditions of outer space uses a tank having first and second chambers separated by a movable piston. Carbon dioxide inlets, water inlets and carbonated water outlets as well as agitators are provided for each chamber. The piston in the tank can be driven by introduction of either carbon dioxide or water into one chamber in order to reduce the volume of the other chamber and to cause carbonated water held therein to be discharged. Both chambers will be able to sequentially form carbonated water when both carbon dioxide and water is contained in one of the chambers.

31 Claims, 3 Drawing Sheets

NON-VENTING MICROGRAVITY CARBONATOR AND METHOD

BACKGROUND OF THE INVENTION

1. Field of the Invention

The present invention relates to a carbonator and a method for carbonating for use on earth or in the microgravity conditions of outer space. The carbonator and method provide for mixing of carbon dioxide and water to form carbonated water without the need for venting excess carbon dioxide.

2. Description of the Background Art

Various carbonators are known in the art. However, these carbonators require that carbon dioxide will exit the carbonator in addition to the carbonated water. Also, the carbonation level will be determined by the water temperature and carbon dioxide pressure. Various prior art arrangements also require external pumps for driving the carbonator as well as separate metering pumps for measuring out the amount of carbon dioxide or water to be introduced to the carbonator.

One prior art arrangement for carbonating water include U.S. Pat. No. 4,629,589 to Gupta et al., entitled "Beverage Dispensing System Suitable for Use in Outer Space", assigned to the same assignee as the present invention. This patent describes an arrangement for carbonating water in the microgravity conditions of outer space.

Accordingly, a need in the art exists for a carbonator and method for carbonating water which is suitable for use in the microgravity conditions of outer space as well as on earth. Such an arrangement should ensure that only carbonated water is released from the device. Further, this device should avoid the use of external metering pumps for introducing carbon dioxide or water into the carbonator.

SUMMARY OF THE INVENTION

Accordingly, it is a primary object of the present invention to provide a carbonator and a method for carbonation which will operate in the zero gravity conditions of outer space as well as on earth.

It is another object of the present invention to provide a carbonator and method for carbonation which releases only carbonated water.

It is a further object of the present invention to provide a carbonator and a method for carbonation which does not require positively driven pumps for carrying out the carbonation.

It is yet another object of the present invention to provide a carbonator and method which avoids the use of a separate metering pump for supplying carbon dioxide and water.

Another object of the present invention is to provide a carbonator and a method for carbonation which is highly reliable and requires limited maintenance.

These and other objects of the present invention are fulfilled by providing a method for carbonating water comprising the steps of providing a carbonator having a movable piston which separates the carbonator into a first chamber and a second chamber, the first chamber initially being filled with carbonated water and the second chamber initially being filled with one of carbon dioxide and water, introducing one of carbon dioxide, water and a combination of carbon dioxide and water into the second chamber whereby the second chamber will be filled with both carbon dioxide and water, moving the piston to reduce the volume of said first chamber in response to introducing into said second chamber, dispensing the carbonated water initially filling with said first chamber, said dispensing being in response to moving said piston, mixing said carbon dioxide and water in said second chamber, and forming carbonated water in said second chamber in response to at least said mixing.

These and other objects of the present invention are also fulfilled by providing a carbonator for producing carbonated water comprising, tank means for holding at least carbon dioxide and water, a movable piston separating the tank means into a first and second chamber, first means for introducing water into the first chamber, first means for introducing carbon dioxide into the first chamber, at least one of said first means causing said piston to move to reduce volume of said first chamber, second means for introducing water into said second chamber, second means for introducing carbon dioxide into said second chamber, at least one of the second means causing the piston to move to reduce the volume of the second chamber, said first chamber permitting carbonated water to be formed therein when both of the first means introduce both water and carbon dioxide thereinto, said second chamber permitting carbonated water to be formed therein when both of said second means introduce both water and carbon dioxide thereinto, first means for permitting discharge of the carbonated water from said first chamber, said first chamber and said first means for permitting discharge preventing release of carbon dioxide from said chamber, and second means for permitting discharge of carbonated water from the second chamber, the second chamber and the second means for permitting discharge also preventing release of carbon dioxide from said carbonator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
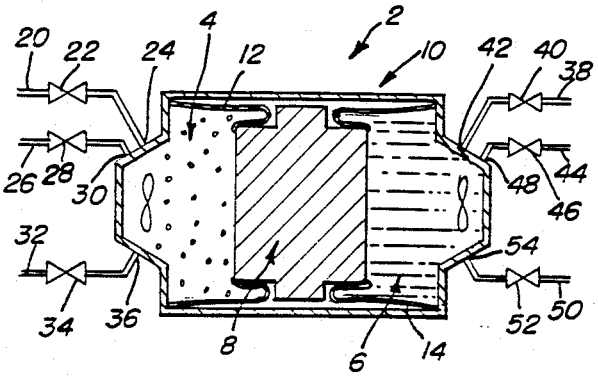
FIG. 1 is a cross-sectional view of the carbonator of the present invention wherein carbonated water is initially being held in the first chamber and water is being held in the second chamber.

Referring in detail to the drawings and with particular reference to FIG. 1, a non-venting microgravity carbonator 2 is shown. This carbonator consists of a first chamber 4 and a second chamber 6 separated by a movable piston 8. This movable piston 8 is a unitary structure such that a single piston will separate the holding tank 10 into the two chambers 4 and 6.

As seen in FIG. 1, a first rolling diaphragm 12 is provided in chamber 4. Also, a second rolling diaphragm 14 is provided in chamber 6. It should be understood that the carbonator 2 shown in all the figures would include such a first and second rolling diaphragm. However, in order to simplify the drawings, this diaphragm has only been indicated in FIG. 1. These rolling diaphragms ensure that an effective low friction seal is maintained between the two chambers 4 and 6. Rather than using first and second rolling diaphragms, a low friction "O-ring" type seal could alternatively be used.

The carbonator 2 is also provided with a carbon dioxide conduit 20 having a carbon dioxide conduit valve 22 and a carbon dioxide inlet 24 for the first chamber 4. Also, a water conduit 26, water conduit valve 28 and water inlet 30 are provided for the first chamber. This first chamber 4 also has a carbonated water conduit 32 with a carbonated water conduit valve 34 and a carbonated water outlet 36.

Likewise, the second chamber 6 has a carbon dioxide conduit 38 with a carbon dioxide conduit valve 40 and a carbon dioxide inlet 42. A water conduit 44 with a water conduit valve 46 and water inlet 48 are also provided for the second chamber 6. Carbonated water may be discharged from the second chamber 6 through a carbonated water conduit 50 having a carbonated water conduit valve 52 and a carbonated water outlet 54.

Figure 2:
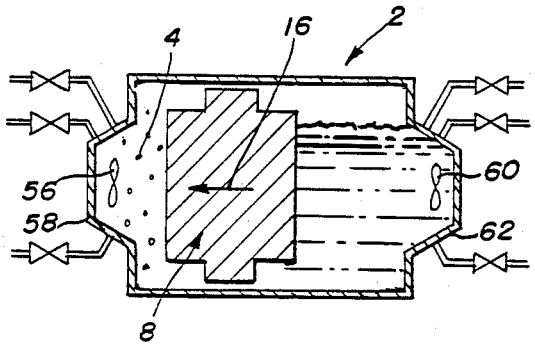
FIG. 2 is a cross-sectional view of the carbonator of the present invention wherein carbonated water is being discharged from the first chamber.

Disposed within the first chamber 4 is an agitator 56 as indicated in FIG. 2. An agitator recess 58 is provided in the first chamber 4 such that the movable piston 8 will not interfere therewith as will be described below. A second agitator 60 is provided in the second chamber 6. Likewise, this agitator has a recess 62 in the second chamber 6. It should be understood that these agitators 56 and 60 may be driven by any known means.

The walls of the holding tank 10 may be insulted so that the water will not warm up during operation of the carbonator. Therefore, saturation pressure will not become excessive during operation of the carbonator.

The operation of the carbonator as shown in FIGS. 1–8 will now be described. Initially, the first chamber 4 will be filled with carbonated water while the second chamber 6 will be filled with water. The carbonation cycle will begin with all valves 22, 28, 34, 40, 46 and 52 being closed. Then, valves 40 and 34 will be opened in order to permit carbon dioxide to be introduced into the second chamber 6 and the carbonated water to be discharged from the first chamber 4. This action will cause the moving piston 8 to move in the direction of arrow 16 as indicated in FIG. 2.

As this piston 8 moves in the direction of arrow 16, the volume of the first chamber 4 will be reduced while the volume of the second chamber 6 is increased.

As the carbon dioxide entering the second chamber 6 through conduit 38 moves the piston in the direction of arrow 16, a counterpressure force is provided such that the carbon dioxide will remain in solution in the carbonated water in the first chamber 4. Thus, a steady stream of carbonated water may be dispensed and the creation of a burst of carbon dioxide gas during dispensing may be avoided.

Figure 3:
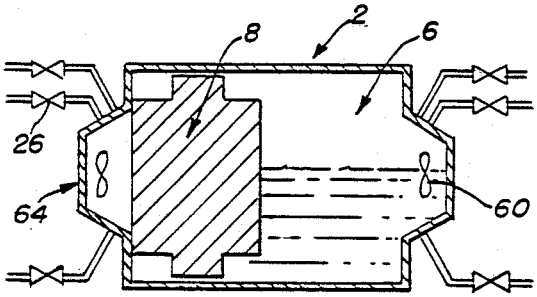
FIG. 3 is a cross-sectional view of the carbonator of the present invention wherein the second chamber has a maximum volume.

The piston will eventually bottom out in a position which is proximate to an end 64 of the first chamber 4 as indicated in FIG. 3. The second chamber 6 will then be filled with equal volumes of carbon dioxide and water. The carbon dioxide which is introduced into the chamber is at a pressure of 22 psig.

Figure 4:
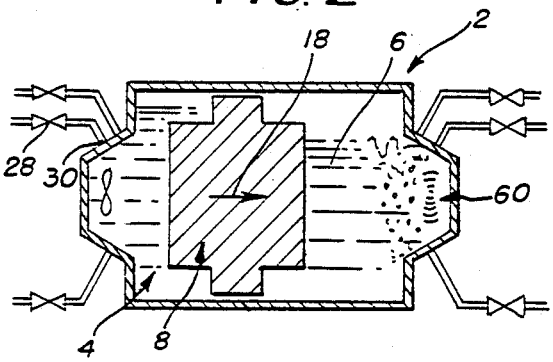
FIG. 4 is a cross-sectional view of the carbonator of the present invention wherein water is being introduced into the first chamber.

After the piston 8 has bottomed out as indicated in FIG. 3, the carbon dioxide conduit valve 40 for the second chamber and the carbonated water conduit valve 34 for the first chamber will be closed. The second chamber 6 will now hold equal volumes of water and carbon dioxide at 22 psig. The agitator 60 will then be turned on and the water conduit valve 28 will be opened. Thus, water may enter the first chamber 4 through water inlet 30. This action forces the movable piston 8 in the direction of arrow 18 as indicated in FIG. 4.

Water entering the first chamber 4 will be at a pressure of 30 psig and will force the piston 8 in the direction of arrow 18 and will also inherently reduce the volume of the second chamber 6. As the piston moves in the direction of arrow 18, the carbon dioxide will be absorbed into the water in the second chamber 6 and carbonated water will be formed.

Figure 5:
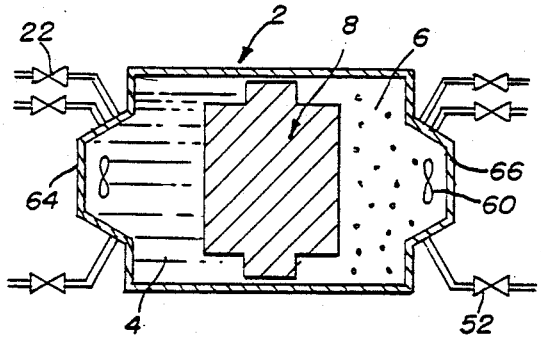
FIG. 5 is a cross-sectional view of the present invention wherein water is being held in the first chamber and carbonated water is being held in the second chamber.
Figure 6:
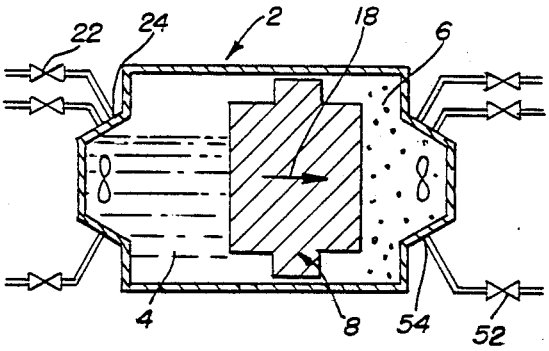
FIG. 6 is a cross-sectional view of the carbonator of the present invention wherein carbonated water is being discharged from the second chamber.

As indicated in FIG. 5, the agitator 60 will be stopped and the piston 8 will assume a position which is midway between the ends 64 and 66 of the holding tank 10. All valves will be closed in the position shown in FIG. 5. The first chamber 4 will be filled with water while the second chamber 6 is filled with water carbonated to 2.5 volumes of carbonation. Then, the carbon dioxide conduit valve 22 for the first chamber will be opened. Also, the carbonated water conduit valve 52 for the second chamber 6 will also be opened. The carbon dioxide entering the first chamber 4 at a pressure of 22 psig forces piston 8 in the direction of arrow 18 as shown in FIG. 6. The volume of the second chamber 6 will be therefore reduced and the carbonated water will be discharged through outlet 54.

Figure 7:
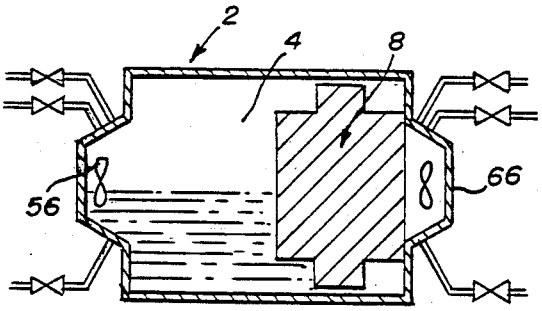
FIG. 7 is a cross-sectional view of the carbonator of the present invention wherein the first chamber has a maximum volume.
Figure 8:
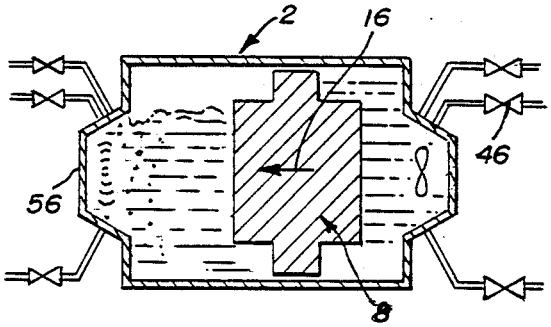
FIG. 8 is a cross-sectional view of the carbonator of the present invention wherein water is being introduced into the second chamber.

The movable piston 8 will bottom out at the end 66 of the second chamber as indicated in FIG. 7. All valves may then be closed and the first chamber 4 will hold equal volumes of carbon dioxide and water. Thereafter, the agitator 56 may be activated and the water conduit valve 46 for the second chamber 6 may be opened. Water will then be introduced into the second chamber 6 and force the piston 8 in the direction of arrow 16 as indicated in FIG. 8. The movable piston 8 will then reach the midpoint of the holding tank 10 and be at the position indicated in FIG. 1.

In the position shown in FIG. 1, the first chamber 4 will be filled with carbonated water while the second chamber 6 is filled with water. The agitator 56 will be stopped and the water conduit valve 46 for the second chamber will be closed. The cycle may thereafter be repeated such that the carbonated water may be dispensed from the first chamber 4 while the second chamber 6 is refilled with carbon dioxide. Thus, this cycle may be repeated to create a sequential discharge of carbonated water from each of the chambers 4, 6.

As will be apparent from the foregoing description, the instant invention may be powered solely by water and carbon dioxide gas pressure. This, arrangement avoids the use of external motors or pumps and thus simplifies the operation of the device and increases the device's reliability.

Separate metering pumps to measure the carbon dioxide gas fed to the first and second chambers 4, 6 are also avoided in the instant invention while the metering of carbon dioxide is accurately and easily carried out.

Figure 9:
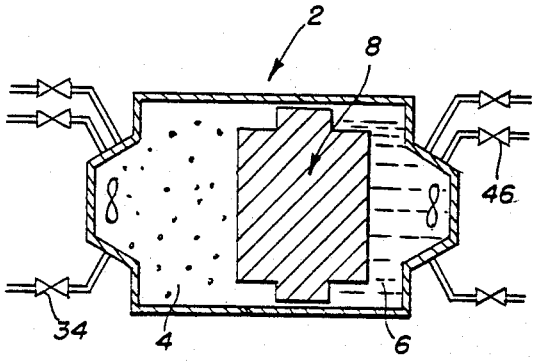
FIG. 9 is a cross-sectional view of a second embodiment of the carbonator of the present invention wherein carbonated water is held in the first chamber.

Referring next to FIGS. 9–16, a second non-venting microgravity carbonator 2 is described. It should be noted that throughout the specification, the reference numerals indicate like elements. As seen in FIG. 9, the movable piston 8 is positioned such that the first chamber 4 has a volume which is generally twice as large as the volume of the second chamber 6. The first chamber 4 will initially be filled with carbonated water while the second chamber 6 will initially be filled with water. The operation of this carbonator shown in FIGS. 9–16 is similar to the carbonator shown in FIGS. 1–8 but involves the use of a high pressure cycle.

Figure 10:
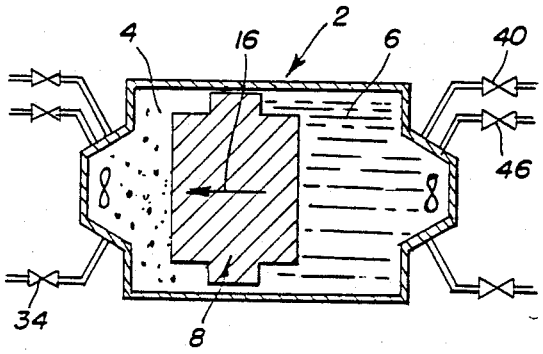
FIG. 10 is a cross-sectional view of the second embodiment of the carbonator of the present invention wherein carbonated water is being discharged from the first chamber.

In operation, the carbonator 2 will be operated by opening carbonated water conduit valve 34 for the first chamber while also opening water conduit valve 46 for the second chamber 6. The introduction of water into the second chamber 6 forces the movable piston 8 in the direction of arrow 16 as indicated in FIG. 10.

Introduction of water into the second chamber 6 not only forces the piston 8 in the direction of arrow 16 but ensures that the carbon dioxide remains in solution in the first chamber 4. This water which is introduced into the second chamber 6 is at a pressure of 75 psig. When the movable piston 8 reaches the position shown in FIG. 10, water conduit valve 46 will be closed and carbon dioxide conduit valve 40 will be opened. In this position, the first chamber 4 will have a volume which is half the volume of the second chamber 6. For instance, the first chamber may contain 10 cubic inches of carbonated water while the second chamber 6 will contain 20 cubic inches of water.

Figure 11:
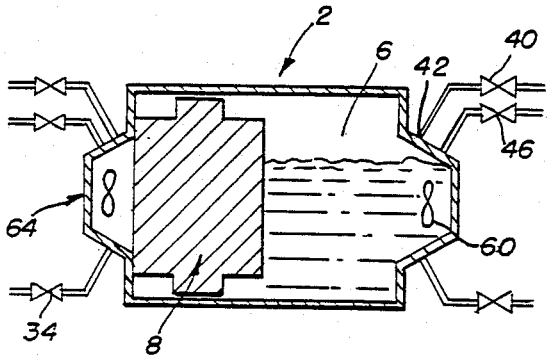
FIG. 11 is a cross-sectional view of the second embodiment of the carbonator of the present invention wherein the second chamber has a maximum volume.

As carbon dioxide is introduced through inlet 42, the movable piston 8 will continue to move in the direction of arrow 16 and will bottom out at the end 64 of the first chamber as indicated in FIG. 11. The second chamber 6 will then contain 10 cubic inches of carbon dioxide and 20 cubic inches of water. Carbonated water conduit valve 34 will be closed as well as carbon dioxide conduit valve 40. The carbon dioxide which has been introduced into the second chamber through the carbon dioxide inlet 42 is at a pressure of 59 psig.

Figure 12:
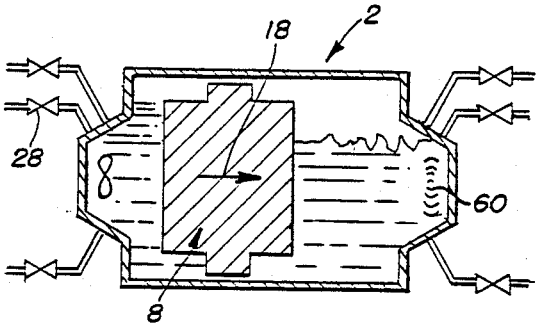
FIG. 12 is a cross-sectional view of the second embodiment of the carbonator of the present invention wherein water is being introduced into the first chamber.
Figure 13:
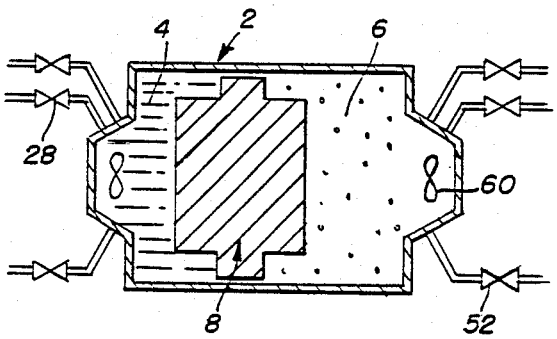
FIG. 13 is a cross-sectional view of the second embodiment of the carbonator of the present invention wherein carbonated water is being held in the second chamber.

Water conduit valve 28 will next be opened such that water at 75 psig may enter the first chamber 4. This action causes the movable piston 8 to move in the direction of arrow 18 as shown in FIG. 12 and the agitator 60 in the second chamber 6 will be activated. The movement of this piston 8 along with the agitator 60 will cause the carbon dioxide and water to begin to mix. As seen in FIG. 13, the agitator 60 may be deactivated and the second chamber will hold water carbonated to 2.5 volumes of carbonation when the piston reaches a position wherein the second chamber 6 has a volume which is twice that of the first chamber 4.

Figure 14:
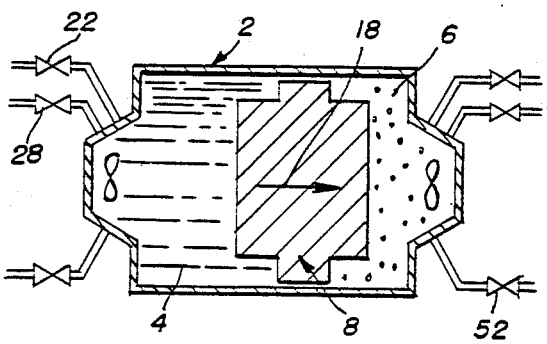
FIG. 14 is a cross-sectional view of the second embodiment of the carbonator of the present invention wherein carbonated water is being discharged from the second chamber.

Thereafter, water conduit valve 28 may remain open while carbonated water conduit valve 52 may also be opened. This action continues to force the movable piston 8 in the direction of arrow 18 as indicated in FIG. 14. When the volume of the first chamber 4 is twice the volume of the second chamber 6, the water conduit valve 28 may be closed and the carbon dioxide conduit valve 22 may be opened. Carbon dioxide may then enter the first chamber at a pressure of 59 psig.

Figure 15:
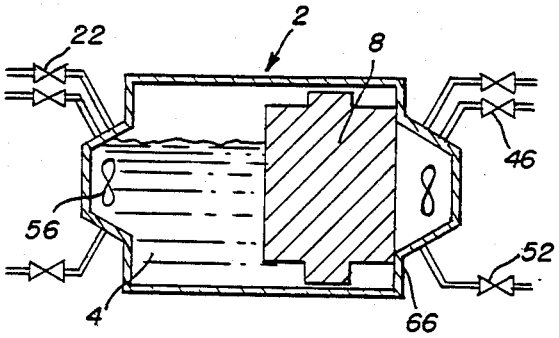
FIG. 15 is a cross-sectional view of the second embodiment of the carbonator of the present invention wherein the first chamber has a maximum volume.
Figure 16:
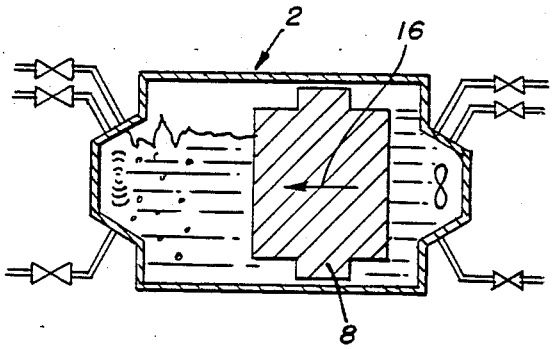
FIG. 16 is a cross-sectional view of the second embodiment of the carbonator of the present invention wherein water is being introduced into the second chamber.
Figure 17:
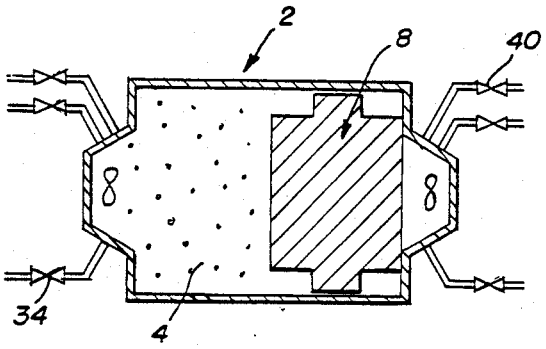
FIG. 17 is a cross-sectional view of a third embodiment of the carbonator of the present invention wherein carbonated water is being held in the first chamber.

The movable piston 8 will continue to move in the direction of arrow 18 and will bottom out adjacent the end 66 of the second chamber as shown in FIG. 15. The first chamber 4 will then be filled with 20 cubic inches of water and 10 cubic inches of carbon dioxide at 50 PSIG. The carbon dioxide conduit valve 22 and the carbonated water conduit valve 52 may then be closed. The agitator 56 may be actuated and the water conduit valve 46 may be opened. This action will cause the movable piston 8 to move in the direction of arrow 16 as indicated in FIG. 16. When the movable piston 8 reaches the position shown in FIG. 9, the cycle may be repeated. Thus, sequential discharging of carbonated water from the carbonator shown in FIGS. 9–16 will be permitted.

Figure 18:
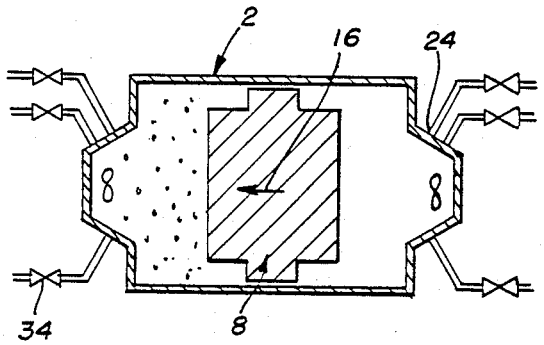
FIG. 18 is a cross-sectional view of the third embodiment of the carbonator of the present invention wherein carbon dioxide is being introduced into the second chamber.

Referring now to FIGS. 17–24, a third non-venting microgravity carbonator 2 is shown. In this arrangement, the first chamber 4 will initially be filled with cold carbonated water at 2.5 volumes of carbonation. The carbonated water conduit valve 34 may be opened while the carbon dioxide inlet valve 40 for the second chamber 6 may also be opened. This action will cause the movable piston 8 to move in the direction of arrow 16 as indicated in FIG. 18. Carbon dioxide will be introduced into the second chamber through carbon dioxide inlet 24 at a pressure of 22 psig. The movable piston 8 will continue to move in the direction of arrow 16 until the piston 8 bottoms out at the end 64 of the first chamber 4.

Figure 19:
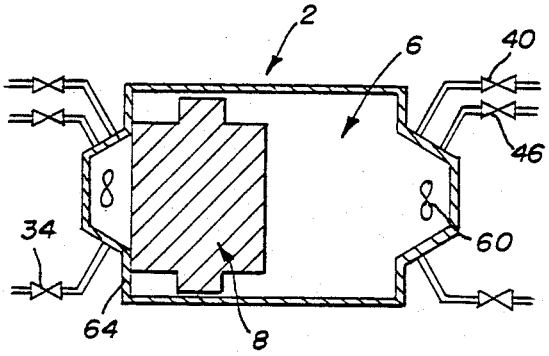
FIG. 19 is a cross-sectional view of the third embodiment of the carbonator of the present invention wherein the second chamber has a maximum volume.
Figure 20:
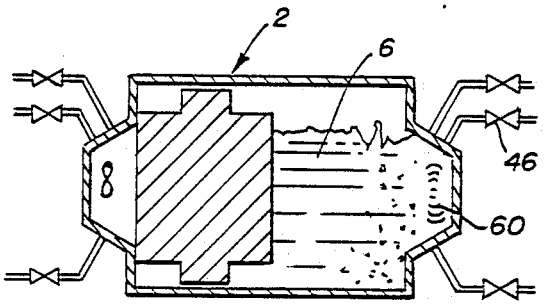
FIG. 20 is a cross-sectional view of the third embodiment of the carbonator of the present invention wherein water is being introduced into the second chamber.
Figure 21:
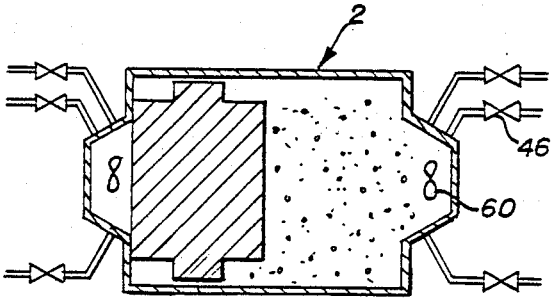
FIG. 21 is a cross-sectional view of the third embodiment of the carbonator of the present invention wherein carbonated water is being held in the second chamber.

As seen in FIG. 19, the second chamber 6 will then be filled with carbon dioxide at 22 psig. The carbonated water conduit valve 34 and the carbon dioxide conduit valve 40 may then be closed. The water conduit valve 46 for the second chamber 6 may be opened while the agitator 60 may be actuated as indicated in FIG. 20. The second chamber 6 may then be filled with water. As seen in FIG. 21, the carbon dioxide and water will mix to form carbonated water at 2.5 volumes. The water conduit valve 46 will then be closed. The agitator 60 may also be turned off.

Figure 22:
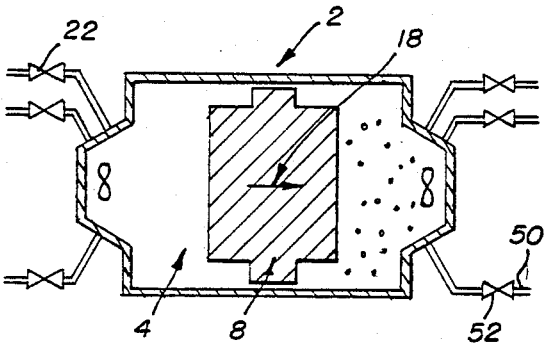
FIG. 22 is a cross-sectional view of the third embodiment of the carbonator of the present invention wherein carbonated water is being discharged from the second chamber.
Figure 23:
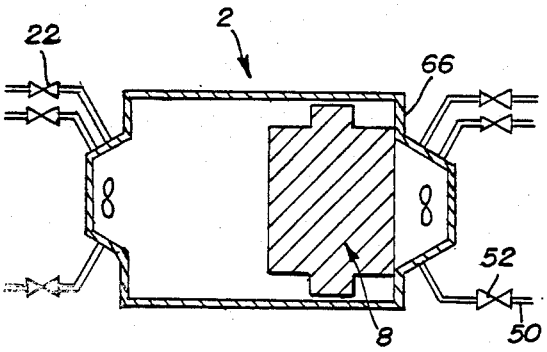
FIG. 23 is a cross-sectional view of the third embodiment of the carbonator of the present invention wherein the first chamber has a maximum volume.

Next, the carbonated water conduit valve 52 may be opened while the carbon dioxide conduit valve 22 for the first chamber 4 may be opened. As seen in FIG. 22, the movable piston 8 will then move in the direction of arrow 18. The volume of the first chamber 4 will increase as the volume of the second chamber 6 decreases. When the carbonated water has been discharged through conduit 50 and the movable piston 8 bottoms out at the end 66 of the second chamber, the piston 8 will be in the position shown in FIG. 23. The carbonated water conduit valve 52 and the carbon dioxide conduit valve 22 may then be closed.

Figure 24:
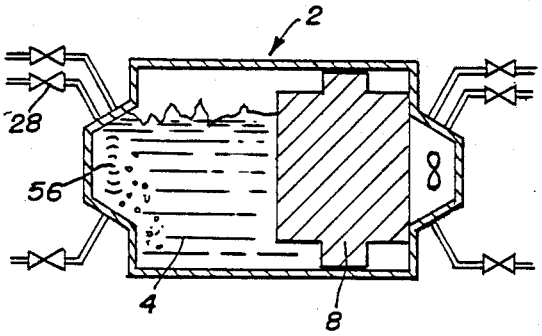
FIG. 24 is a cross-sectional view of the third embodiment of the carbonator of the present invention wherein water is being introduced into the first chamber.

Thereafter, the agitator 56 may be activated while the water conduit valve 28 for the first chamber 4 is opened as indicated in FIG. 24. The first chamber 4 will then be fitted with both water and carbon dioxide and carbonated water will be formed. Thus, the arrangement as shown in FIG. 17 will again the obtained. Thereafter, the carbonator 2 as shown in FIGS. 17–24 may repeat its cycle of operation to sequentially discharge carbonated water from the first and second chambers 4, 6, respectively.

As previously noted, the device of the instant invention is powered by water and carbon dioxide gas pressure. This arrangement therefore avoids the use of external motors or pumps and thus simplifies the operation of the device.

Furthermore, separate metering means for carbon dioxide or water are avoided in the instant invention. Thus, the metering of the carbon dioxide gas may be accurately and easily carried out.

The instant invention also avoids venting carbon dioxide to the atmosphere. In particular, only carbonated water will be discharged from the device of the instant invention.

While the various valves of the instant invention have been recited as being opened and closed, it should be understood that this operation may be carried out manually or may be sensed electronically and controlled by an appropriate electronic circuit.

It should be understood that the carbonator and carbonation method of the instant invention may be utilized in the microgravity conditions of outer space as well as on earth. Also, it is contemplated that a plurality of carbonators may be used such that a continuous discharge of carbonated water is ensured.

While this carbonator and method for carbonation have been disclosed as being used for dispensing carbonated water, any other known solutions may be handled by this system. Further, as this system is contemplated for use in outer space, it should be noted that any recitations to upwardly or downwardly, left-hand or right-hand contained within within the specification have merely been made with reference to the attached drawings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A method for carbonating water comprising the steps of:

providing a carbonator having a movable piston which separates said carbonator into a first chamber and a second chamber, said first chamber initially being filled with carbonated water and said second chamber initially being filled with one of carbon dioxide and water;

introducing one of carbon dioxide, water and a combination of carbon dioxide and water into said second chamber whereby said second chamber will be filled with both carbon dioxide and water;

moving said piston to reduce volume of said first chamber in response to said introducing into said second chamber;

dispensing said carbonated water initially filling said first chamber, said dispensing being in response to moving said piston and said dispensing avoiding release of carbon dioxide from said carbonator;

mixing said carbon dioxide and water in said second chamber; and forming carbonated water in said second chamber in response to at least said mixing.

2. The method for carbonating water as recited in claim 1 further comprising the steps of:

introducing one of carbon dioxide, water and a combination of carbon dioxide and water into said first chamber whereby said first chamber will be filled with both carbon dioxide and water;

moving said piston to reduce volume of said second chamber in response to introducing into said first chamber;

dispensing said carbonated water formed in said second chamber in response to moving said piston to reduce the volume of said second chamber, said dispensing avoiding release of carbon dioxide from said carbonator;

mixing said carbon dioxide and water in said first chamber; and forming carbonated water in said first chamber in response to at least said mixing in said first chamber.

3. The method for carbonating as recited in claim 2, wherein the steps are repeatedly carried out for permitting sequential discharges of carbonated water from both said first and said second chambers.

4. The method for carbonating as recited in claim 2, further comprising the step of using the method in microgravity conditions of outer space.

5. The method for carbonating water as recited in claim 1, further comprising the steps of:

introducing water into said first chamber;

said forming in said second chamber being accomplished by both said mixing and said introducing water into said first chamber;

further introducing one of carbon dioxide and a combination of water and carbon dioxide into said first chamber;

moving said piston to reduce volume of said second chamber in response to said further introducing into said first chamber;

dispensing the carbonated water formed in said second chamber in response to moving said piston to reduce volume of said second chamber;

mixing said carbon dioxide and water in said first chamber;

introducing water into said second chamber;

moving said piston to reduce the volume of said first chamber in response to introducing water into said second chamber; and forming carbonated water in said first chamber in response to both said moving said piston to reduce the volume of said first chamber and said mixing in said first chamber.

6. The method for carbonating water as recited in claim 1, wherein said forming carbonated water in said second chamber is carried out when said piston is generally at a midpoint of said carbonator.

7. The method for carbonating water as recited in claim 1, wherein said forming carbonated water in said second chamber is carried out when said piston is located at a position wherein said second chamber generally has twice as much volume as said first chamber.

8. The method for carbonating water as recited in claim 1, wherein said forming carbonated water in said second chamber is carried out when said piston is proximate an end of said carbonator.

9. A method for carbonating water comprising the steps of:

providing a carbonator having a movable piston which separates said carbonator into a first chamber and a second chamber; the first chamber initially being filled with carbonated water and the second chamber initially being filled with water;

introducing carbon dioxide into said second chamber;

moving said piston to reduce volume of said first chamber in response to introducing carbon dioxide;

dispensing said carbonated water initially filling said first chamber in response to moving said piston, said dispensing avoiding release of carbon dioxide from said carbonator;

mixing said carbon dioxide and water in said second chamber;

introducing water into said first chamber;

moving said piston to reduce volume of said second chamber in response to introducing water; and forming carbonated water in said second chamber in response to both said moving said piston to reduce volume of said second chamber and said mixing.

10. The method for carbonating water as recited in claim 9, further comprising the steps of:

introducing carbon dioxide into said first chamber;

moving said piston to further reduce the volume of said second chamber in response to introducing carbon dioxide into said first chamber;

dispensing said carbonated water formed in said second chamber in response to moving said piston to furthe reduce the volume of said second chamber;

mixing said carbon dioxide and water in said first chamber;

introducing water into said second chamber;

moving said piston to reduce the volume of said first chamber in response to introducing water into said second chamber; and forming carbonated water in said first chamber in response to both said moving said piston to reduce the volume of said first chamber and said mixing in said first chamber.

11. The method for carbonating water as recited in claim 10, wherein said dispensing carbonated water initially filling said first chamber and said dispensing said carbonated water formed in said second chamber begins when said piston is located generally at a midpoint of said carbonator.

12. The method for carbonating water as recited in claim 10, wherein the steps are repeatedly carried out for permitting sequential discharges of carbonaed water from both said first and said second chambers.

13. The method for carbonating water as recited in claim 10, further comprising the step of using an agiator for said mixing said carbon dioxide and water in both said first and said second chambers.

14. The method for carbonating water as recited in claim 10, further comprising the step of using the method in microgravity conditions of outer space.

15. A method for carbonating water comprising the steps of:

providing a carbonator having a movable piston which separates said carbonator into a first chamber and a second chamber, the first chamber initially being filled with carbonated water and the second chamber initially being filled with water;

introducing water into said second chamber;

moving said piston in response to introducing water, said piston moving to reduce volume of said first chamber and moving to a point whereat said second chamber has a volume which is generally twice as large as the volume of said first chamber;

introducing carbon dioxide into said second chamber;

moving said piston in response to introducing carbon dioxide in order to further reduce the volume of said first chamber;

dispensing said carbonated water initially filling said chamber in response to moving said piston in response to introducing both water and carbon dioxide into said second chamber;

mixing said carbon dioxide and water in said second chamber;

introducing water into said first chamber;

moving said piston to reduce volume of said second chamber in response to introducing water into said first chamber; and forming carbonated water in said second chamber in response to both said moving said piston to reduce volume of said second chamber and said mixing.

16. The method for carbonating water as recited in claim 15, further comprising the steps of:

introducing additional water into said first chamber;

moving said piston in response to introducing additional water into said first chamber, said piston moving to reduce the volume of the second chamber and moving to a point whereat said first chamber has a volume which is generally twice as large as the volume of said first chamber;

introducing carbon dioxide into said first chamber;

moving said piston in response to introducing carbon dioxide in order to furthe reduce the volume of said second chamber;

dispensing carbonated water formed in said second chamber in response to moving said piston to reduce the volume of said second chamber when introducing both water and carbon dioxide into said first chamber;

mixing said carbon dioxide and water in said first chamber;

reintroducing water into said second chamber;

moving said piston in response to said reintroducing water in order to reduce the volume of said first chamber, said piston moving to the point whereat said first chamber has a volume which is generally twice as large as the volume of said first chamber; and forming carbonated water in said first chamber in response to both said moving said piston in response to reintroducing and said mixing in said first chamber.

17. The method for carbonating water as recited in claim 16, wherein the steps are repeatedly carried out for permitting sequential discharges of carbonated water from both said first and said second chambers.

18. The method for carbonating water as recited in claim 16, further comprising the step of using an agitator for said mixing said carbon dioxide and water in both said first and said second chambers.

19. The method for carbonating water as recited in claim 16, further comprising the step of using the method in microgravity conditions of outer space.

20. A method for carbonating water comprising the steps of:

providing a carbonater having a movable piston which separates said carbonator into a first chamber and a second chamber, said carbonator further having first and second ends, said first chamber being adjacent said first end and said second chamber being adjacent said second end, said first chamber initially being filled with carbonated water and said piston initially being located proximate to said second end;

introducing carbon dioxide into said second chamber;

moving said piston proximate to said first end in response to introducing carbon dioxide;

dispensing said carbonated water initially filling said first chamber in response to moving said piston, said dispensing avoiding release of carbon dioxide from said carbonator;

introducing water into said second chamber;

mixing said carbon dioxide and water in said second chamber;

forming carbonated water in said second chamber in response to said introducing water and said mixing.

21. The method for carbonating water as recited in claim 20, further comprising the steps of:

introducing carbon dioxide into said first chamber;

moving said piston proximate to said second end in response to introducing carbon dioxide to said first chamber;

dispensing said carbonated water formed in said second chamber in response to moving said piston proximate to said second end;

introducing water into said first chamber;

mixing said carbon dioxide and water in said first chamber; and forming carbonated water in said first chamber in response to said introducing water into said first chamber and said mixing.

22. The method for carbonating water as recited in claim 21, wherein the steps are repeatedly carried out for permitting sequential discharges of carbonated water from both said first and said second chambers.

23. The method for carbonating water as recited in claim 21, further comprising the step of using an agitator for said mixing said carbon dioxide and water in both said first and second chambers.

24. The method for carbonating water as recited in claim 21, further comprising the step of using the method in microgravity conditions of outer space.

25. A carbonator for producing carbonated water comprising:

tank means for holding at least carbon dioxide and water;

a movable piston separating said tank means into a first and second chamber;

first means for introducing water into said first chamber;

first means for introducing carbon dioxide into said first chamber, at least one of said first means causing said piston to move to reduce volume of said second chamber;

second means for introducing water into said second chamber;

second means for introducing carbon dioxide into said second chamber, at least one of said second means causing said piston to move to reduce volume of said first chamber;

said first chamber permitting carbonated water to be formed therein when both said first means introduce both water and carbon dioxide thereinto, said second chamber permitting carbonated water to be formed therein when both said second means introduce both water and carbon dioxide thereinto;

first means for permitting discharge of carbonated water from said first chamber, said first chamber and said first means for permitting discharge preventing release of carbon dioxide from said carbonator; and second means for permitting discharge of carbonated water from said second chamber, said second chamber and said second means for permitting discharge also preventing release of carbon dioxide from said carbonator.

26. The carbonator as recited in claim 25, wherein both said first and second chambers are each provided with an agitator for aiding formation of carbonated water.

27. The carbonator as recited in claim 25, wherein said agitator is for use in the microgravity conditions of outer space.

28. The carbonator as recited in claim 25, wherein said first means for introducing carbon dioxide and said second means for introducing carbon dioxide both include conduits having outlets to their respective chambers, said chambers having a known volume which measures out a known amount of carbon dioxide at a known pressure whereby the use of a separate meter is avoided.

29. The carbonator as recited in claim 25, wherein said first means for introducing carbon dioxide introduces carbon dioxide after carbonated water within said second chamber begins to be discharged and said piston is located generally at a midpoint of said tank means AND wherein said second means for introducing carbon dioxide introduces carbon dioxide after carbonated water within said first chamber begins to be discharged and said piston is located generally at said midpoint.

30. The carbonator as recited in claim 25, wherein said first means for introducing carbon dioxide introduces carbon dioxide after carbonated water within said second chamber begins to be discharged and said piston is located at a position wherein the volume of said first chamber is generally twice the volume of said second chamber AND wherein said second means for introducing carbon dioxide introduces carbon dioxide after carbonated water within said first chamber begins to be discharged and said piston is located at a position wherein the volume of said second chamber is generally twice the volume of said first chamber.

31. The carbonator as recited in claim 25, wherein said tank means has a first end and a second end, said first chamber being adjacent said first end and said second chamber being adjacent said second end and wherein said first means for introducing water introduces water after said piston is proximate to said second end AND wherein said second means for introducing water introduces water after said piston is proximate to said first end.

* * * * *